US006092239A

United States Patent [19]

Pogrebitsky et al.

[11] Patent Number: 6,092,239

[45] Date of Patent: Jul. 25, 2000

[54] FOLDABLE DISPOSABLE CAP AND METHOD FOR FOLDING THEREOF

[76] Inventors: Eduard Pogrebitsky, 2111 Washington Ave., Santa Monica, Calif. 90403; Michael Guz, 1441 Veteran Ave., Apt. 126, Los Angeles, Calif. 90024

[21] Appl. No.: 09/003,305

[22] Filed: Jan. 6, 1998

Related U.S. Application Data

[63] Continuation-in-part of application No. 29/057,298, Jul. 22, 1996, abandoned, which is a continuation-in-part of application No. 29/051,100, Mar. 4, 1996, abandoned.

[51] Int. Cl.[7] ..... A42B 1/00

[52] U.S. Cl. ..... 2/200.3; 2/195.2; 2/209.3

[58] Field of Search ..... 2/195.1, 195.2, 2/200.3, 209.3, 209.7, 171

[56] References Cited

U.S. PATENT DOCUMENTS

D. 255,953 7/1980 Gates et al. .
D. 338,544 8/1993 Scheinbaum .
D. 340,796 11/1993 Oates .
4,021,859 5/1977 Burke .
4,282,607 8/1981 Randall .
4,453,276 6/1984 Smith et al. .
5,247,709 9/1993 Epply .
5,428,842 7/1995 Wise ..... 2/195.1

*Primary Examiner*—Diana Oleksa
*Attorney, Agent, or Firm*—Loeb & Loeb LLP; F. Jason Far-hadian

[57] ABSTRACT

A foldable cap is disclosed made from a flat semi-rigid material cut into a plurality of middle panels for forming the crown portion of a cap and two lateral panels for forming the brim of the cap. Each of the middle panels and the lateral panels have a free end and a fixed end connected to the remainder of the uncut semi-rigid material. The middle panels of the cap are folded and overlapped proximate their free ends to form a cupped area for receiving a user's head. The angled lateral portions are then bent toward each other to overlap at least one free end of the middle panels so as to form a brim for the cupped area.

24 Claims, 10 Drawing Sheets

FOLDABLE DISPOSABLE CAP AND METHOD FOR FOLDING THEREOF

RELATED APPLICATIONS

This application is a continuation-in-part of application Ser. No. 29/057,298 filed Jul. 22, 1996, now abandoned, which is a continuation-in-part of application Ser. No. 29/051,100 filed Mar. 4, 1996, now abandoned, both of which are incorporated herein by reference.

BACKGROUND OF THE INVENTION

1. Filed of the Invention

The present invention generally relates to hats for providing sun protection to a wearer, and in particular to a foldable cap made of a disposable material and method for folding such a cap.

2. Description of the Related Art

Various types of disposable hats have existed in the past for protecting the top of people's heads. For example, paper hats have long been folded from newspapers by painters to protect their hair from dripping paint. In the food service industry, especially in fast food restaurants, hats made of inexpensive, disposable materials were developed for the sanitary purpose of preventing hair shedding into food. Similarly, in the health care environment, hats for covering a surgeon's head during an operation were also developed.

However, none of these prior hats proved suitable for use in an outdoor setting were there is a need for sun protection of the head. For example, it is common for spectators at sporting events to protect their heads from the sun with a cap having a visor, commonly known as a baseball cap. Such baseball caps are typically made of fabric materials which are relatively expensive to manufacture and are of a reusable and permanent nature. As such permanent baseball caps cost between $12–20, in the event that a spectator does not have a baseball cap or has forgotten to bring a baseball cap, the cost of a permanent baseball cap may prove to be prohibitively expensive, especially where an entire family would need to purchase caps.

Accordingly, there exists a need for an inexpensive, disposable cap for providing protection from the sun and which resembles caps of a more permanent nature.

SUMMARY OF THE INVENTION

The present invention is directed to an inexpensive, disposable cap for providing protection from the sun, which fits the head well, and which resembles caps of a more permanent nature. The present invention is also directed to a method for manufacturing and for folding such a cap. The present invention provides an inexpensive alternative to caps of a reusable and more permanent nature, while retaining the sun protection function of such permanent caps.

In the preferred embodiment of the present invention, the foldable cap is made from a single piece of a flat semi-rigid material. A portion of the material is cut into multiple middle panels for forming the crown portion of a cap and two lateral panels for forming the brim of the cap. Each of the middle panels and the lateral panels have a free end and a fixed end connected to the remainder of the uncut material. The middle panels of the cap are folded and overlapped proximate their free ends to form a cupped area for receiving a user's head. The angled lateral portions are then bent toward each other to overlap at least one free end of the middle panels so as to form a brim for the cupped area of the hat. The overlapping free ends of the panels are held together with a fastener, such as a folding metal clip, a plastic snap-fit button, a rivet, hook and loop fasteners sold under the trade name Velcro, or an adhesive for example.

In the preferred embodiment, the foldable cap of the present invention in its folded state is in the shape of a baseball cap having a visor. However, the foldable cap of the present invention need not include a visor and may have various alternative configurations, such that in the folded state, the cap could be in the shape of a beret, bowler, derby, fedora, beanie, or yarmulka, for example.

To simplify manufacturing and shipping of the cap of the present invention, it is preferred that the cap be die cut from a single piece of material such that all necessary cuts are made at one time, including any openings required for fasteners. The fasteners are then applied to the appropriate areas of the material. The caps may then be shipped and stored in bulk in a flat and unfolded state. The caps may then be folded by the consumer or the retailer prior to being worn.

The semi-rigid material of the cap of the present invention may be made of a material having a sufficient density to be substantially opaque to sunlight. For example, the material may be a stiffly flexible paper-like material, such as kraft paper, and may include a water-repellent material. Additional fold lines may be formed at the two fixed ends of the lateral panels to facilitate bending of the lateral panels.

OBJECTS OF THE INVENTION

It is an object of the present invention to provide a foldable cap that provides sun protection.

It is another object of the present invention to provide a disposable foldable cap with the same or higher functional quality of reusable caps of a more permanent nature.

It is yet another object of the present invention to provide a foldable cap that is simple and inexpensive to manufacture.

It is still another object of the present invention to provide a foldable cap that is easy and inexpensive to ship and store.

It is another object of the present invention to provide a foldable cap that is attractive and resembles a baseball cap.

These and other objects of the present invention will become apparent from a review of the accompanying drawings and the detailed description of the drawings.

DETAILED DESCRIPTION

Figure 1:
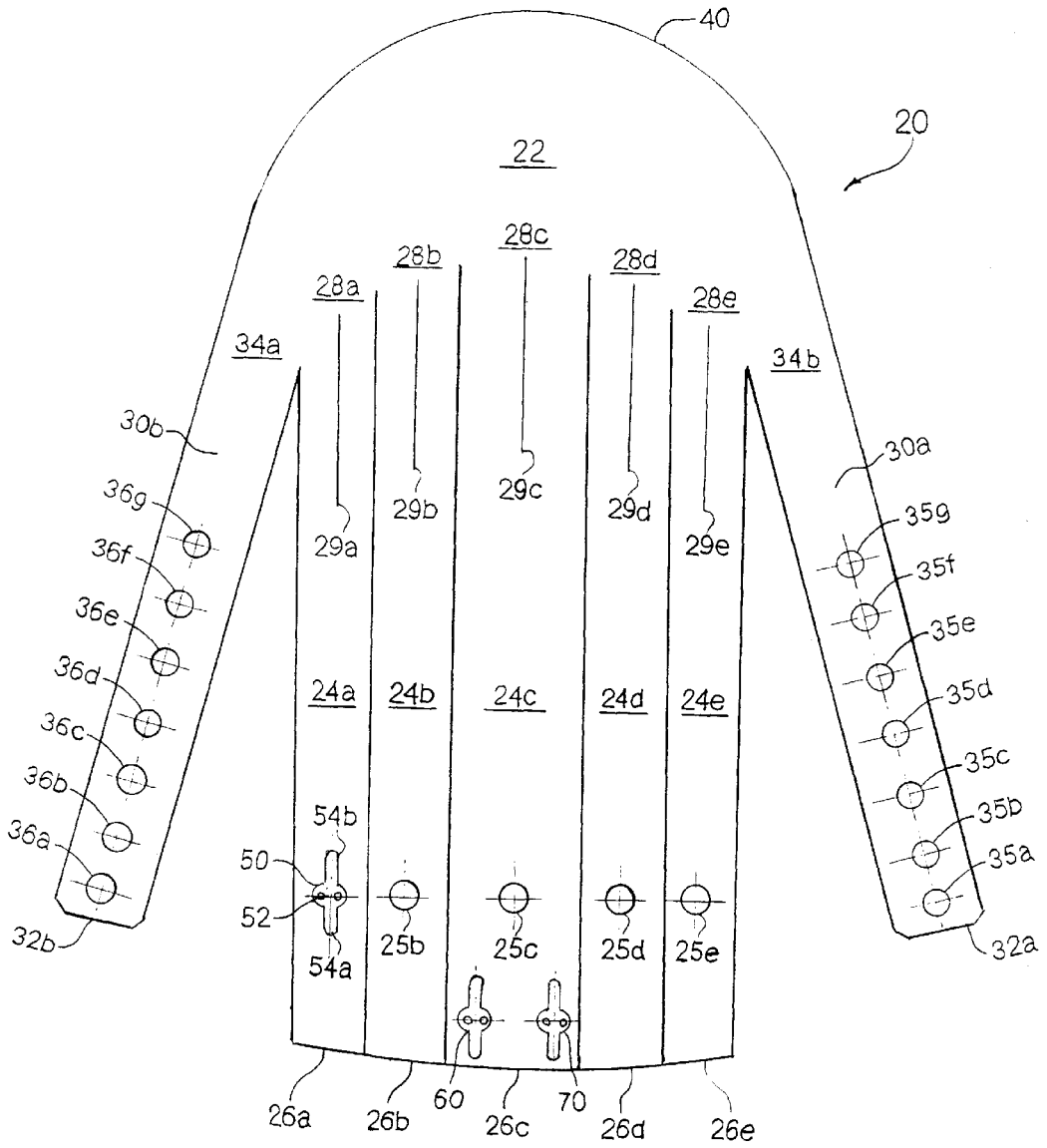
FIG. 1 is a top plan view of a single piece of the material of the foldable cap of the present invention shown in an unfolded state.
Figure 2:
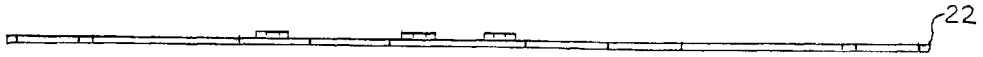
FIG. 2 is an end view of the material of FIG. 1.
Figure 3:
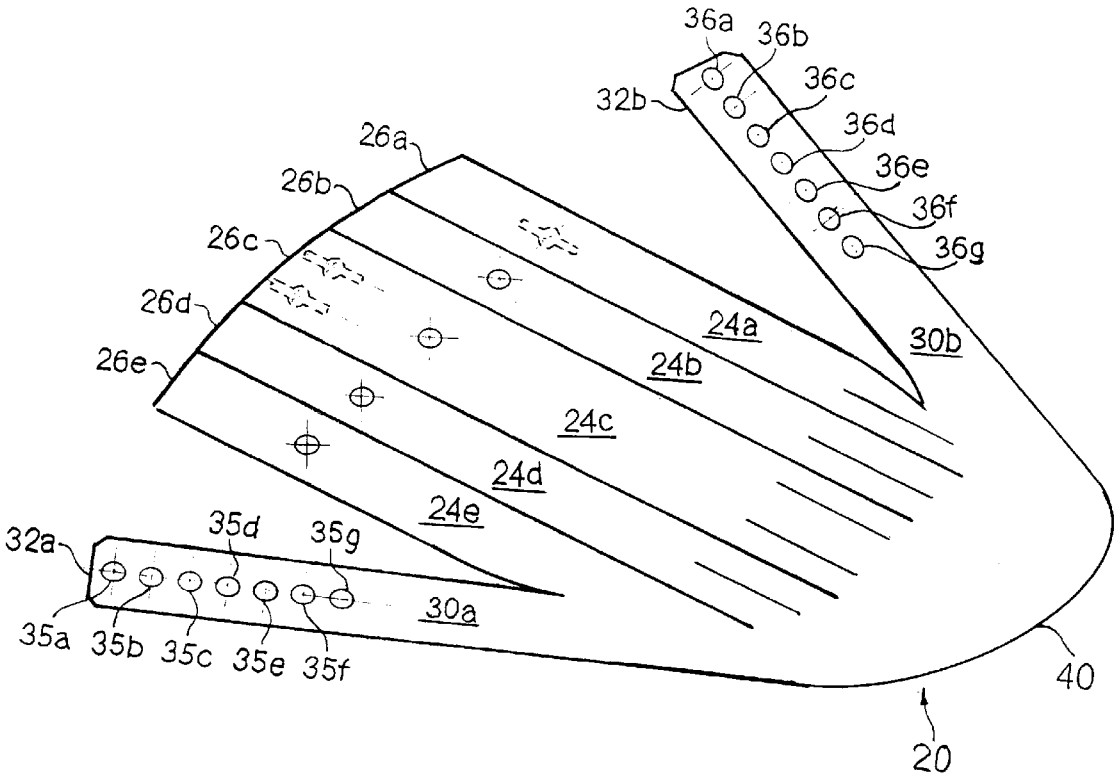
FIG. 3 is a rear perspective view of the material of foldable cap of the present invention shown in an unfolded state.

Referring to FIGS. 1–3, the preferred embodiment of the cap of the present invention, generally referred to by the numeral 20, is shown in a fully unfolded state. Cap 20 is made from a single sheet of a semi-rigid, foldable material 22 such as a stiffly flexible paper-like material such as for example sixty to ninety pound test kraft paper. It is further appreciated that material 22 can be a fabric or plastic sheet or any material suited for the intended purpose of the present invention. The outer surfaces of cap 20 can also be made water repellent with a silicone spray or an acrylic varnish for example, and may be colored or printed for special occasional and promotional uses. In the unfolded state, material 22 has a length of approximately 15½ inches and a width at its widest point of approximately 18 inches.

As shown in FIGS. 1 and 3, in the unfolded state, the material 22 is preferably a single flat piece. Material 22 is cut into a plurality of middle panels 24*a–e* and lateral angled panels 30*a–b*. A plurality of openings 25*b–e* are made into the middle panels 24 *b–e*, receptively, approximately 2–3 inches from the tips of free ends 26*b*–26*e*, respectively. A plurality of openings 35*a–g* and 36*a–g* spaced apart approximately ¾ inches are made into lateral angled panel 30*a* and 30*b*, respectively, for receiving a portion of a fastener. A plurality of slits 29*a–e* are made into middle panels 24*a–e*, respectively, to enhance the flexibility of middle panels 24*a–e* and to provide ventilation while cap 20 is being worn. Material 22 is preferably cut with a commercially well-known die and can be cut in a single stamp cut making all the necessary cuts at one time, including openings 35*a–g* and 36*a–g*, and slits 29*a–e*. In this manner, a single punch of a die makes a completed product from material 22, requiring only the addition of the fasteners described below.

Each of the middle panels 24*a–e* and the lateral panels 30*a–b* have a free end 26*a–e* and 32*a–b*, respectively, and a fixed end 28*a–e* and 34*a–b*, respectively, connected to the remainder of the uncut material 22. To form cap 20, middle panels 24*a–e* are folded and overlapped proximate their free ends 26*a–e* to form a cupped area for receiving a user's head. Angled lateral panels 30*a–b* are then bent toward each other to overlap at least one free end 26*a–e* of middle panels 24*a–e* so as to form a brim for the rear of cupped area. The remainder of uncut material 22 forms a visor 40 oriented toward the front of cap 20.

Figure 4:
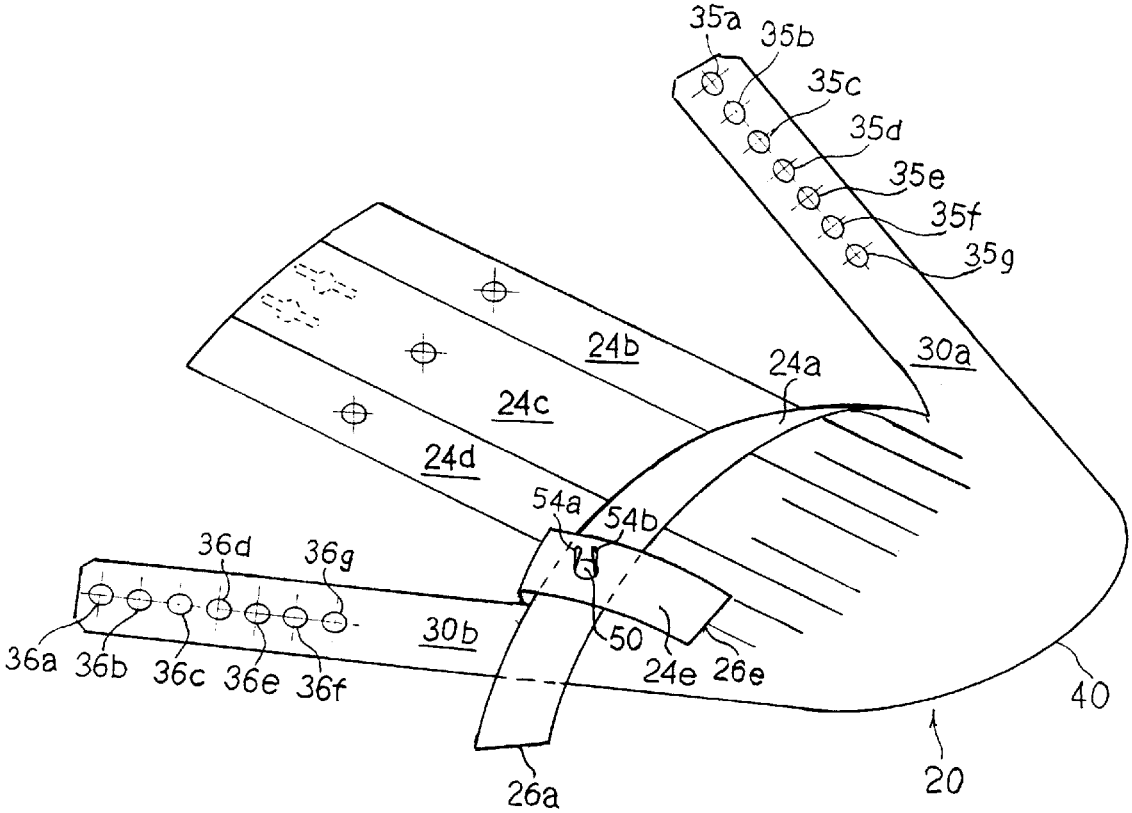
FIG. 4 is a rear perspective view of the foldable cap of the present invention shown in a partially folded state with the free ends of two middle panels overlapping and held by a fastener.

Successive folding stages of cap 20 are illustrated in FIGS. 4–9. As shown in FIG. 4, a rear perspective view of cap 20 is shown in a partially folded state with free ends 26*a* and 26*e* of two middle panels 24*a* and 24*e* overlapping. Free end 26*a* includes a fastener 50 which in the preferred embodiment is a metal clip having a base 52 for securement to material 22 of middle panel 24*a* and having flexible arms 54*a* and 54*b*. In the preferred embodiment, fastener 50 is positioned medially on middle panel 24*a* approximately 2–3 inches from the tip of free end 26*a*. When free ends 26*a* and 26*e* are overlapping, fastener 50 is corresponds in position to opening 25*e*. Flexible arms 54*a* and 54*b* are then bent toward each other so as to pass through opening 25*e* and maintain middle panels 24*a* and 24*e* in the correct overlapping orientation. Flex arms 54*a* and 54*b* are kept closed together at this stage of the folding process.

Figure 5:
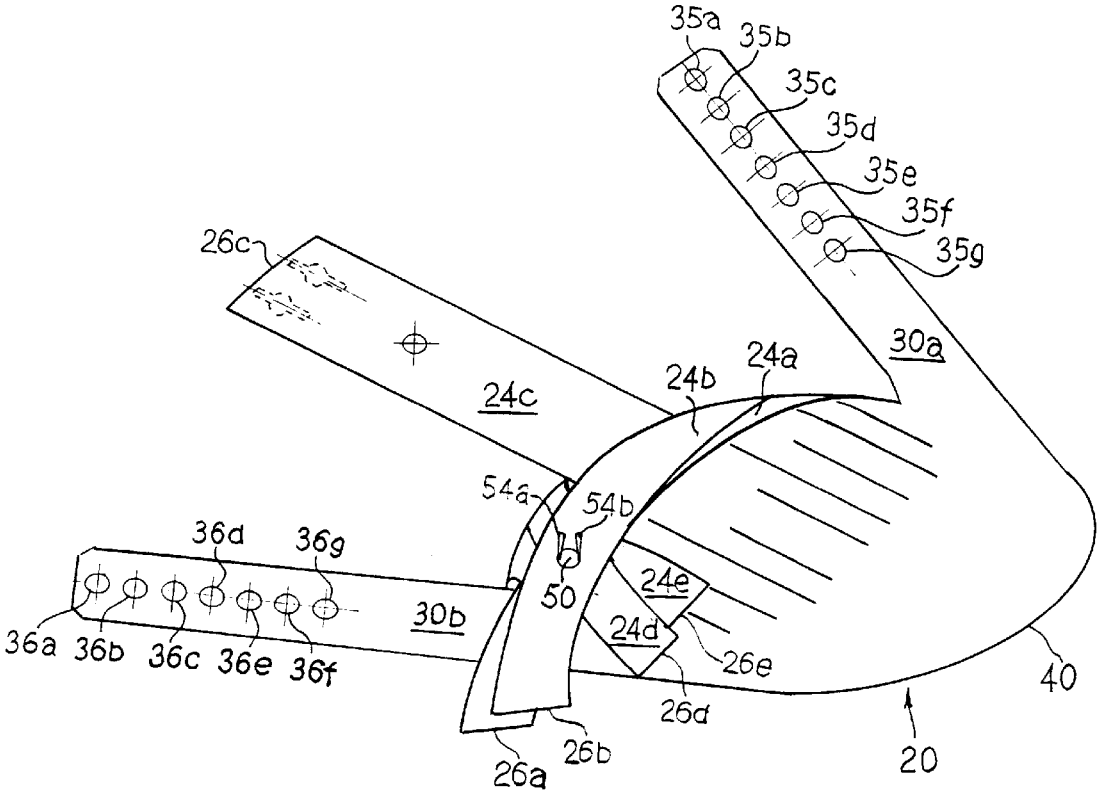
FIG. 5 is a rear perspective view of the foldable cap of the present invention shown in a partially folded state with the free ends of third and fourth middle panels overlapping the free ends of the first and second middle panels shown in FIG. 3 and held by a fastener.

In FIG. 5, free ends 26*b* and 26*d* of third and fourth middle panels 24*b* and 24*d* are shown overlapping the free ends 26*a* and 26*e* of middle panels 24*a* and 24*e*. Openings 25*b* and 25*d* are overlapped in a concentric orientation so as to allow flexible arms 54*a* and 54*b* of fastener 50 to pass there through. In this manner, middle panels 24*b* and 24*d* are maintained in the correct overlapping orientation. Flex arms 54*a* and 54*b* are still kept closed together at this stage of the folding process.

Figure 6:
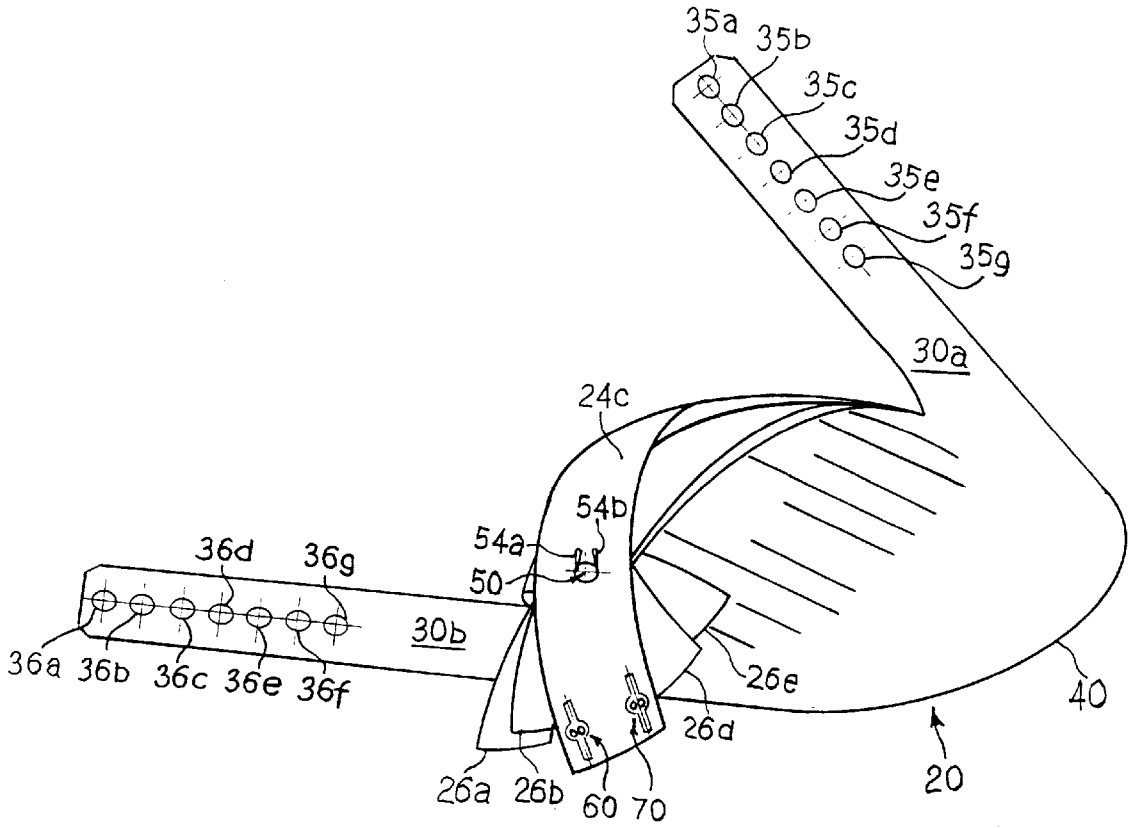
FIG. 6 is a rear perspective view of the foldable cap of the present invention shown in a partially folded state with the free end of a fifth middle panel overlapping the free ends of the four middle panels shown in FIG. 4 and held by fasteners.
Figure 7:
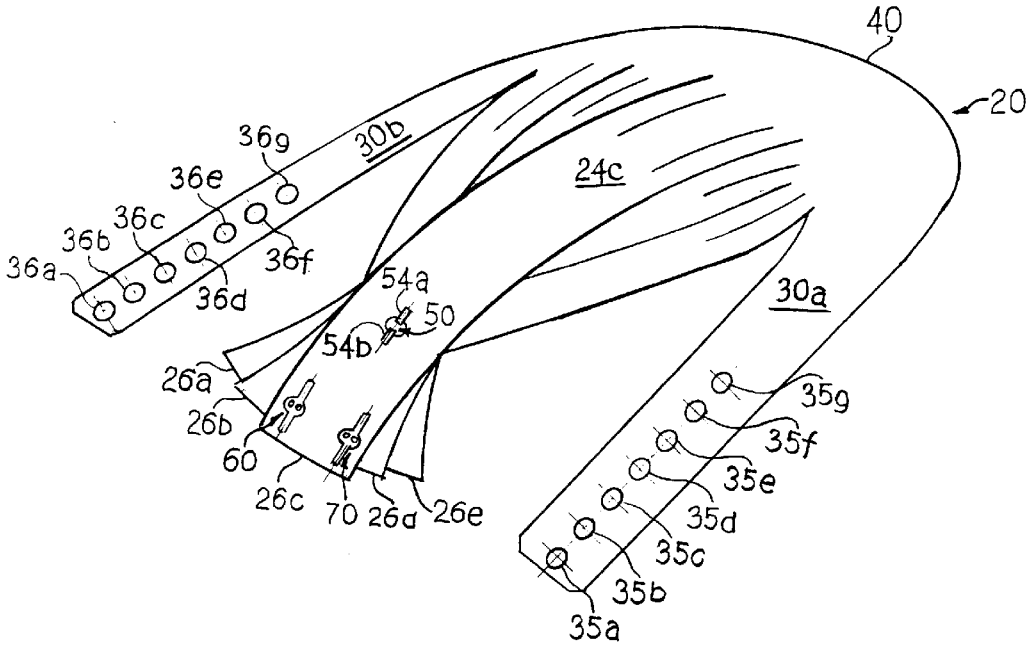
FIG. 7 is a top perspective view of the foldable cap of the present invention shown in a partially folded state with the free end of a fifth middle panel overlapping the free ends of the four middle panels shown in FIG. 4 and held by fasteners.

As shown in FIGS. 6–7, free end 26*c* of a fifth middle panel 24*c* is overlapping the free ends 26*a–b* and 26*d–e* of four middle panels 24*a–b* and 24*d–e*, respectively. In this manner, middle panel 24*c* is maintained in the correct overlapping orientation relative to middle panels 24*a–b* and 24*d–e*. Fastener 50 acts as a pivot point to permit middle panels 24*a–e* to pivot about fastener 50 in a fan-like manner to create a cupped area for receiving a user's head. After the cupped area for receiving the head is properly formed, flex arms 54*a* and 54*b* are then bent back to their flat position to fasten middle panels 24*a–e* in the overlapped position at this stage of the folding process.

Figure 8:
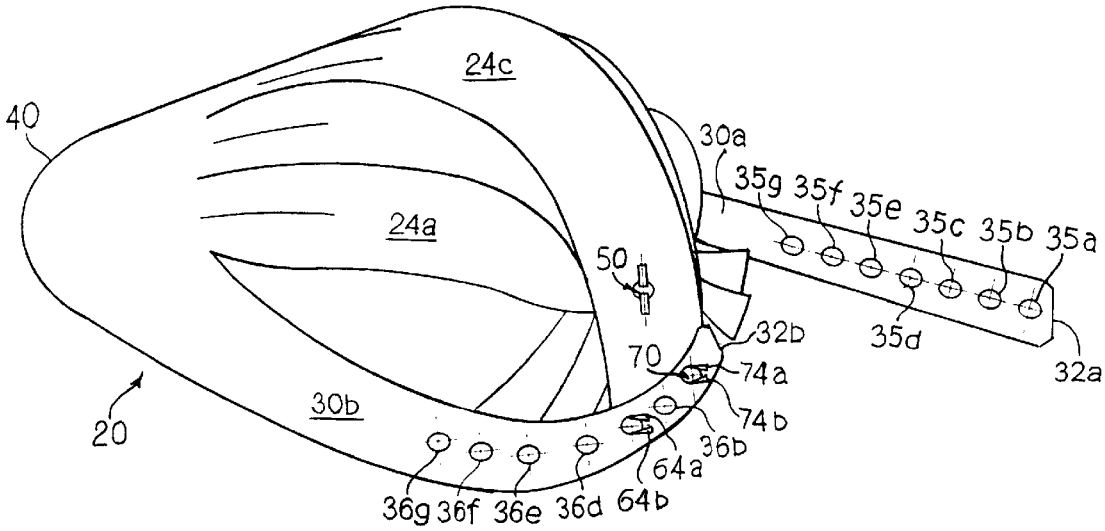
FIG. 8 is a rear perspective view of the foldable cap of the present invention shown in a partially folded state with the free end of a first lateral panel overlapping the free end of the fifth middle panel and held by fasteners.
Figure 9:
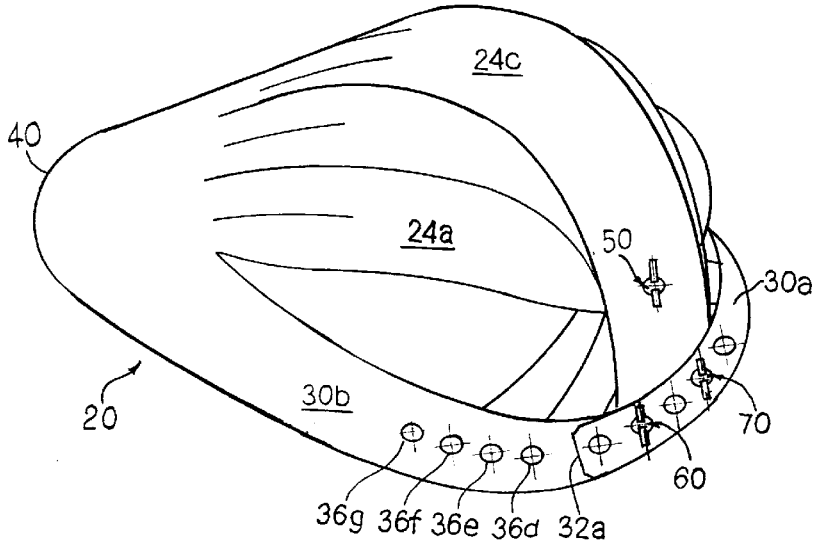
FIG. 9 is a rear perspective view of the foldable cap of the present invention shown fully folded and secured by fasteners.
Figure 10:
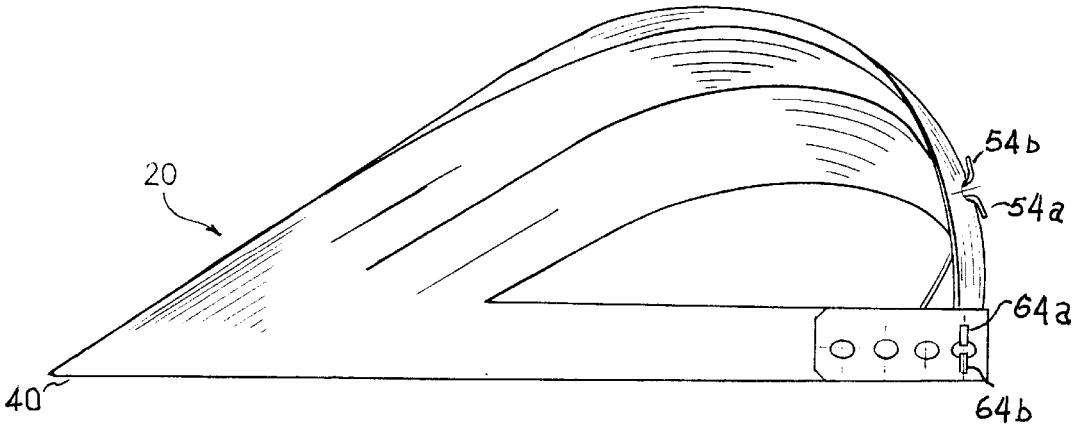
FIG. 10 is a side elevational view of the foldable cap of the present invention shown fully folded and secured by fasteners.
Figure 11:
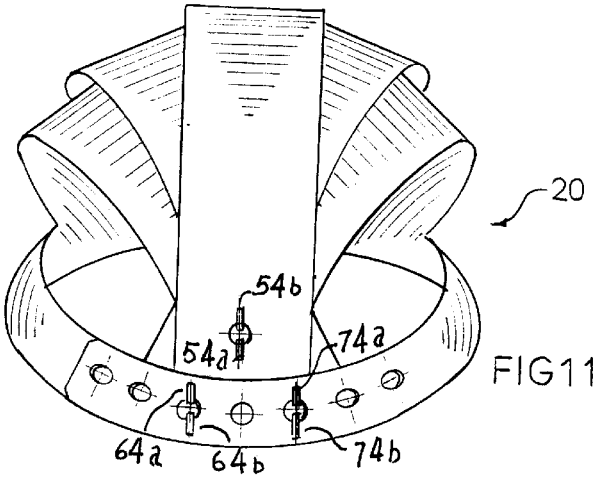
FIG. 11 is a rear elevational view of the foldable cap of the present invention shown fully folded and secured by fasteners.
Figure 12:
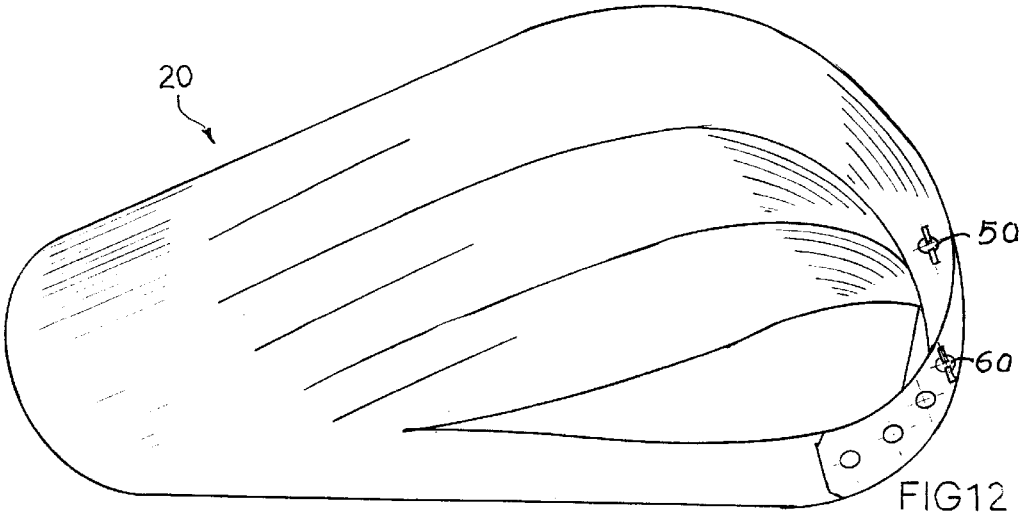
FIG. 12 is a side perspective view of the foldable cap of the present invention shown fully folded and secured by fasteners.
Figure 13:
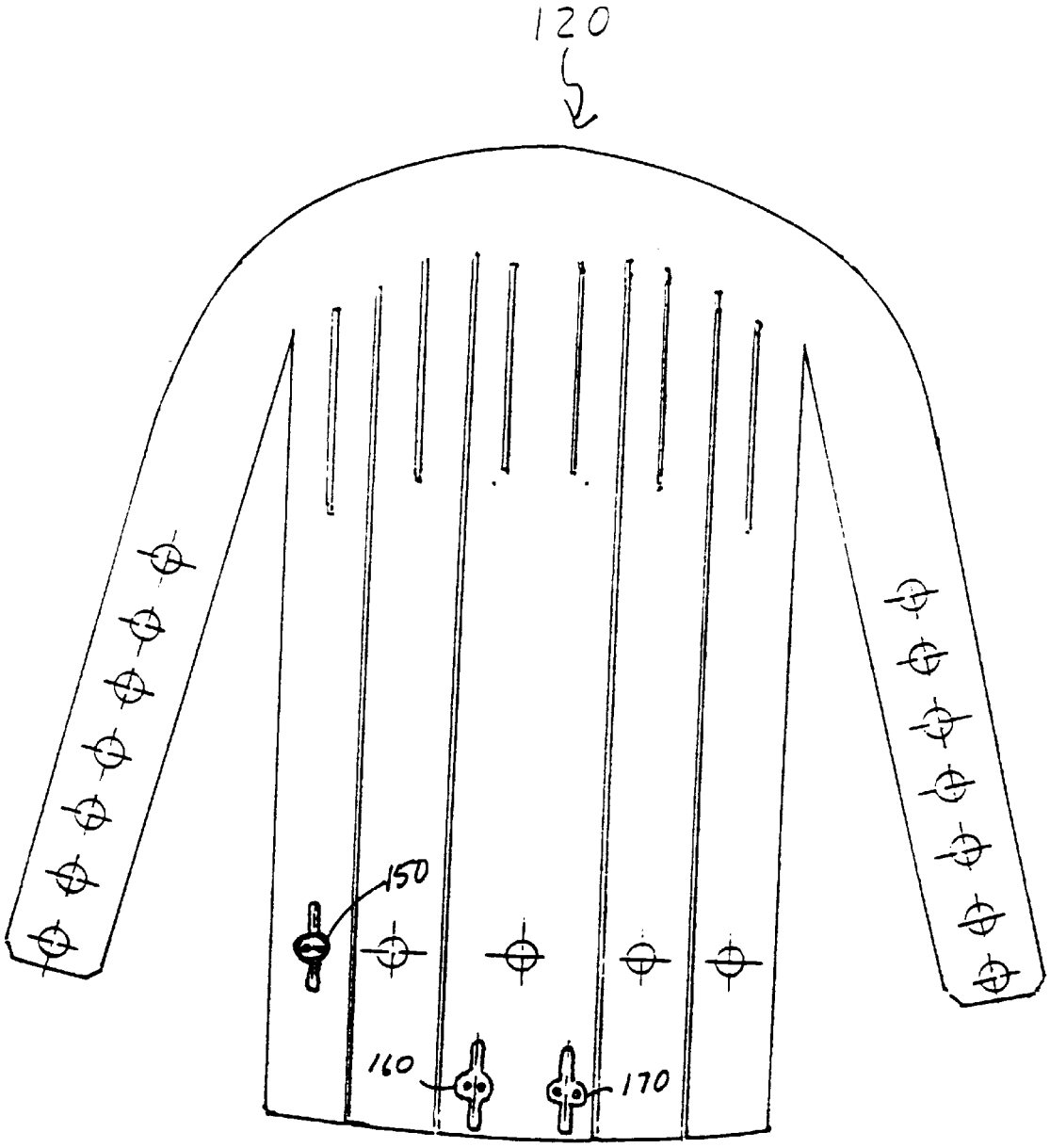
FIG. 13 is a top plan view of a single piece of the material of an alternative embodiment of the foldable cap of the present invention shown in an unfolded state.
Figure 14:
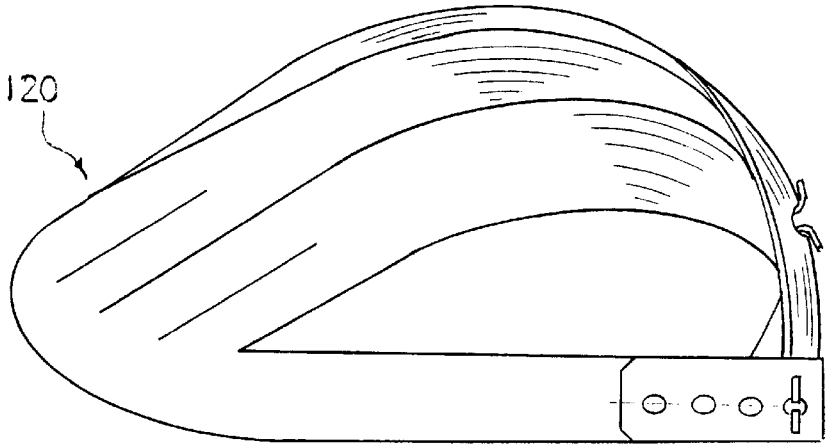
FIG. 14 is a side elevational view of the foldable cap of an alternative embodiment of the present invention shown fully folded and secured by fasteners.
Figure 15:
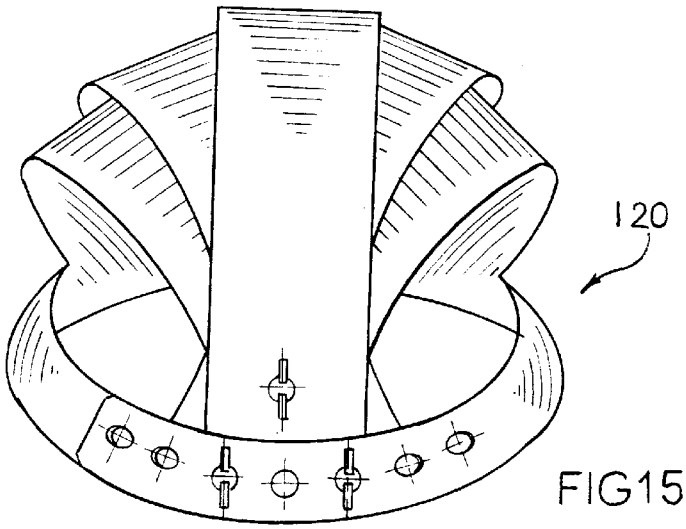
FIG. 15 is a rear elevational view of an alternative embodiment of the foldable cap of the present invention shown fully folded and secured by fasteners.
Figure 16:
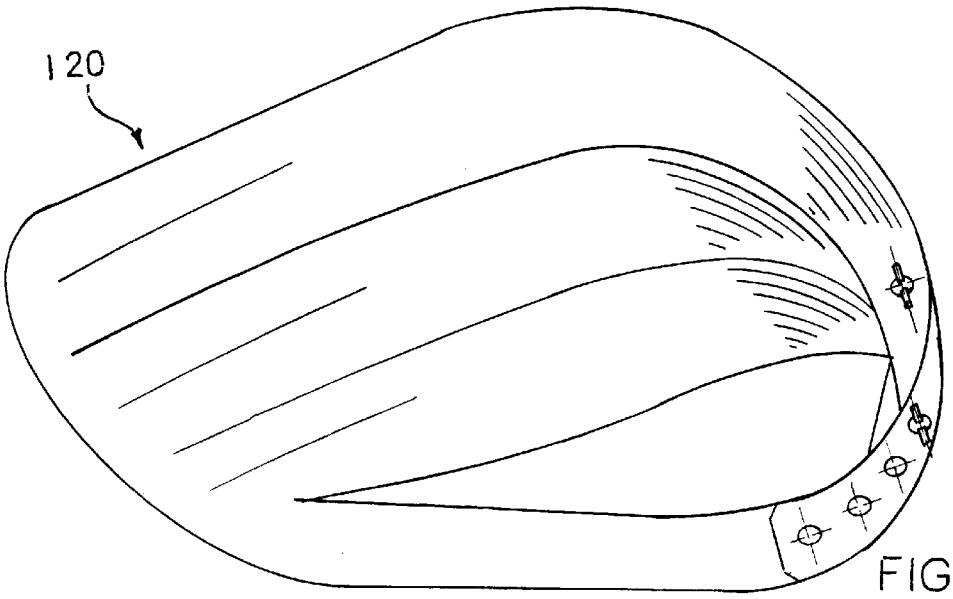
FIG. 16 is a side perspective view of an alternative embodiment of the foldable cap of the present invention shown fully folded and secured by fasteners.

As shown in FIG. 8, free end 32*b* of lateral panel 30*b* is overlapping free end 26*c* of fifth middle panel 24*c*. Openings 36*a–b* are shown overlapping fasteners 60 and 70, such flex arms 64*a–b* and 74*a–b* passing through openings 36*a–b*, respectively.

As shown in FIGS. 9–12, free end 32*a* of lateral panel 30*a* is shown overlapping free end 32*b* of lateral panel 30*b*. Openings 35*a–b* are shown overlapping fasteners 60 and 70, similar to fastener 50 described above, such that flex arms 64*a–b* and 74*a–b* pass through openings 35*a–b*, respectively, and are bent in a flat position to maintaining lateral panel 30*a* correctly positioned against middle panel 24*c*. Cap 20 is now in the fully folded state and ready to wear.

Cap 20 is adjustable to fit various head sizes simply by varying which of openings 35*a–g* and 36*a–g* are coupled to fasteners 60 and 70 respectively. For smaller head sizes, openings 35*e–g* and 36*e–g* are used. For larger head sizes, openings 35*a–c* and 36*a–c* are used. In addition to being a metal clasp, it is appreciated that fasteners 50, 60, and 70 can be any type of fastening device for the purpose of maintaining the panels of cap 20 in place, such as but not limited to rivets, clips, hook and loop fasteners sold under the trade name Velcro, buttons, two-sided tape, adhesives, and the like. It is further appreciated that instead of fasteners, lateral panels can be held in place in a "belt and loop" arrangement wherein the loop is formed by cutting a slit into an opposite lateral panel for receiving the free end of the other lateral panel.

Referring to FIGS. 13–16, an alternative embodiment of the cap of the present invention is shown and generally referred to by the numeral 120. Cap 120 has a similar configuration to cap 20 but does not have a visor 40. Accordingly, cap 120 has a an overall domed configuration. It is appreciated that the cap of the present invention can have various configurations such that in the folded state, the cap could be in the shape of a beret, bowler, derby, fedora, beanie, or yarmulka, for example.

While the present invention has been described with regards to the preferred embodiment and a number of alternative embodiments, it is recognized that other embodiments of the present invention may be devised which would not depart from the scope of the present invention.

What is claimed is:

1. A foldable cap comprising a flat semi-rigid material cut into a plurality of middle panels and two lateral panels, each of said plurality of middle panels and said lateral panels having a free end and a fixed end connected to the remainder of said material, said middle panels being folded and overlapped proximate their free ends to form a cupped area for receiving a user's head, said lateral panels being bent toward each other to overlap at least one free end of said middle panels so as to form a rim for said cupped area.

2. The foldable cap of claim 1, further comprising a fastener for securing together said free ends of said middle panels.

3. The foldable cap of claim 2, wherein said fastener includes a clasp.

4. The foldable cap of claim 2, wherein said fastener is a pivot point for said free ends of said middle panels permitting said middle panels to pivot about said fastener in a fan-like manner.

5. The foldable cap of claim 2, wherein said fastener includes a hook and loop fastener.

6. The foldable cap of claim 2, wherein said fastener includes two-sided tape.

7. The foldable cap of claim 2, wherein said fastener includes a rivet.

8. The foldable cap of claim 1, further comprising a plurality of fasteners for securing together said free ends of said lateral panels and said at least one free end of said middle panels.

9. The foldable cap of claim 8, wherein said fasteners include clasps.

10. The foldable cap of claim 8, wherein said fasteners include hook and loop fastener.

11. The foldable cap of claim 8, wherein said fasteners include two-sided tape.

12. The foldable cap of claim 8, wherein said fasteners include rivets.

13. The foldable cap of claim 1, further comprising slits in said plurality of middle panels for increasing flexibility of said middle panels.

14. The foldable cap of claim 1, wherein at least a portion of said material forms a visor for said cap.

15. The foldable cap of claim 1, wherein said material is folded in the shape of a baseball cap.

16. The foldable cap of claim 1, wherein said material is folded in the shape of a beret.

17. The foldable cap of claim 1, wherein said material is folded in the shape of a domed cap.

18. The foldable cap of claim 1, wherein said material is folded in the shape of a beanie.

19. The foldable cap of claim 1, wherein said material is plastic coated.

20. The foldable cap of claim 1, wherein said material is of sufficient thickness to block out sun light.

21. The foldable cap of claim 1, wherein said material is water repellent.

22. A one-piece foldable cap comprising:

a brim section;

a pair of adjacent first and second left hand crown sections extending from said brim section whereby said second left hand crown section may be fastened over said first left hand crown section;

a pair of adjacent first and second right hand crown sections extending from said brim section whereby said second right hand crown section may be fastened over said first right hand crown section;

a middle crown section extending from said brim section for fastening over said pair of adjacent first and second left hand crown sections and over said pair of adjacent first and second right hand crown sections to form a shaped crown for said one-piece foldable cap;

a first cap band extending from one end of said brim section;

a second cap band extending from another end of said brim section for attaching to said first cap band and over said middle crown section for head-size adjustment of said one-piece foldable cap.

23. A method for folding a foldable cap made of a flat semi-rigid material cut into a plurality of middle panels and two lateral panels, each of the plurality of middle panels and the lateral panels having a free end and a fixed end connected to the remainder of the material, said method of folding the cap comprising the steps of:

folding the middle panels and overlapping the middle panels proximate their free ends to form a cupped area for receiving a user's head; and bending the lateral panels toward each other to overlap at least one free end of the middle panels so as to form a rim for said cupped area.

24. The method of claim 23 further comprising the step of fastening together the free ends of the middle panels and lateral panels.

* * * * *